US006491008B1

(12) United States Patent
Zubeck

(10) Patent No.: US 6,491,008 B1
(45) Date of Patent: Dec. 10, 2002

(54) VARIABLE VALVE TIMING ADJUSTABLE ROLLER ROCKER ARM ASSEMBLY

(75) Inventor: Michael Wayne Zubeck, Dearborn, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 3 days.

(21) Appl. No.: 09/682,786

(22) Filed: Oct. 18, 2001

(51) Int. Cl.[7] ..... F01L 1/30

(52) U.S. Cl. ..... 123/90.16; 123/90.25; 123/90.39

(58) Field of Search ..... 123/90.16, 90.25, 123/90.44, 90.27, 90.39; 251/279, 231, 234; 74/469, 559, 519

(56) References Cited

U.S. PATENT DOCUMENTS

| | | | | |
|---|---|---|---|---|
| 4,151,817 A | | 5/1979 | Mueller | |
| 4,986,227 A | | 1/1991 | Dewey, III | |
| 5,016,581 A | * | 5/1991 | Parsons | 123/90.16 |
| 5,080,054 A | | 1/1992 | Nakamura | |
| 5,251,586 A | | 10/1993 | Koga et al. | |
| 5,544,626 A | | 8/1996 | Diggs et al. | |
| 5,577,469 A | | 11/1996 | Muller et al. | |
| 5,655,488 A | | 8/1997 | Hampton et al. | |
| 5,732,669 A | * | 3/1998 | Fischer et al. | 123/90.16 |
| 5,787,849 A | * | 8/1998 | Mitchell | 60/668 |
| 5,899,180 A | * | 5/1999 | Fischer | 123/90.16 |
| 6,058,895 A | | 5/2000 | Hermsen | |
| 6,311,659 B1 | * | 11/2001 | Pierik | 123/90.15 |
| 6,357,405 B1 | * | 3/2002 | Tsuji et al. | 123/90.16 |

FOREIGN PATENT DOCUMENTS

JP 54-114633 6/1979

OTHER PUBLICATIONS

SAE Publication, "Variable Valve Actuation TOPTEC®: The State of the Art", Sep. 11–12, 2000. Ypsilanti Marriott at Eagle Crest, Ypsilanti, MI, 8 pp.

* cited by examiner

*Primary Examiner*—Thomas Denion
*Assistant Examiner*—Ching Chang

(57) ABSTRACT

A rocker arm assembly having an adjustably located cam roller that permits modification of valve timing for an internal combustion engine. An adjustment control shaft having an adjustment cam operates through a linkage to move the cam roller along the rocker arm and relative to the cam shaft of the engine.

16 Claims, 1 Drawing Sheet

VARIABLE VALVE TIMING ADJUSTABLE ROLLER ROCKER ARM ASSEMBLY

BACKGROUND OF INVENTION

1. Field of the Invention

The present invention relates to a valve lifter rocker arm for an internal combustion engine.

2. Background Art

Valves for internal combustion engines are generally opened and closed to allow for the intake and exhaust of gases in cylinders of the engine. Valves are operated by various valve lifter mechanisms including rocker arms and roller finger follower assemblies. Timing valve opening and closing is important to maximize fuel efficiency, assure complete combustion, and maximize engine output. Adjusting valve timing can lead to improvements in fuel economy, engine emissions, torque and idle quality.

Many different approaches have been proposed for providing adjustable valve timing. Some prior art approaches include independent lifter control for each cylinder by means of electrical solenoids or by changing the pivot point for a rocker arm. Various other approaches have also been proposed.

There is a need for a system and apparatus for providing adjustable valve timing wherein the valve timing may be adjusted in a synchronized manner to minimize variation of timing from cylinder to cylinder. There is also a need for a simple and effective valve timing adjustment mechanism that may be used with intake or exhaust valves. There is also a need for a valve timing adjustment mechanism that is amenable to dual overhead cam and single overhead cam applications. There is a further need to provide a simple and effective way to deactivate cylinders by deactivating valve lifter operation selectively when a cylinder is not firing pursuant to a variable displacement engine operation strategy.

The above problems and objectives are addressed by the present invention as summarized below.

SUMMARY OF INVENTION

According to one aspect of the present invention, a valve timing system for an internal combustion engine having a rotating cam that operates at least one valve is provided. A rocker arm is pivotally attached to the engine. The rocker arm has a cam arm extending toward the rotating cam and a valve arm that contacts a valve stem. A cam roller is attached to the cam arm and is adjustable within a range of positions along the length of the cam arm. The cam roller is supported on the cam arm to selectively contact the rotating cam. A linkage is connected to the cam roller and the rocker arm. The linkage is used to adjust the position of the cam roller to change the timing of the valve of the engine.

According to another aspect of the present invention, a rocker arm assembly is provided for an internal combustion engine. The engine has at least one valve that is opened and closed in a timed manner to port combustion gases for a combustion chamber of the internal combustion engine. The internal combustion engine has at least one cam shaft and at least one cam that is rotated by the cam shaft in accordance with the operating cycle of the internal combustion engine. The cam has a lobe that is rotated to contact the rocker arm assembly to open and close the valve. The rocker arm assembly comprises a rocker arm pivotally secured to the engine that has a valve stem engaging arm and a cam engaging arm on opposite its ends. A roller is adjustably secured to the cam engaging arm and is held on the cam engaging arm in a position to contact the cam as it is rotated by the cam shaft. An adjustment link is provided for shifting the roller relative to the cam engaging arm to cause the roller to contact the lobe of the cam within a range of rotational positions relative to the cam shaft.

Other features of the invention include providing a cam arm that has a pair of spaced flanges between which the cam roller is secured. The cam roller is preferably rotatably secured to the cam arm. The cam roller may be secured to the cam arm by a shaft that extends through a slot formed in the cam arm.

The linkage comprises an adjustment link and a cam roller that is secured to the cam arm by a shaft that is engaged by one end of the adjustment link. The linkage may comprise at least one adjustment cam that is attached to an adjustment control shaft and the adjustment link. The adjustment control shaft may be rotated to rotate the adjustment cam relative to the rocker arm to cause the adjustment link to move the cam roller on the cam arm.

A bushing may be mounted on the adjustment control shaft and secured to the rocker arm wherein the bushing is rotatable relative to the adjustment control shaft and the rocker arm mounting shaft.

According to another aspect of the invention, the slot formed in the cam arm extends generally lengthwise relative to the cam arm. The one end of the slot in the cam arm may be curved away from the rotating cam so that the cam roller may be moved to a recessed position on the cam arm in which the cam roller does not contact the rotating cam.

These and other aspects of the valve timing system and rocker arm assembly of the present invention will be better understood in view of the attached drawings and following detailed description of the preferred embodiments of the invention.

DETAILED DESCRIPTION

Figure 1:
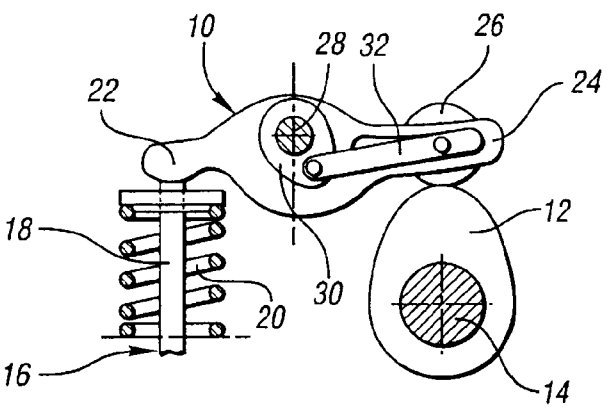
FIG. 1 is an elevation view of a rocker arm assembly shown in conjunction with a rotating cam and valve of an internal combustion engine.

Referring now to FIG. 1, a rocker arm assembly, generally referred to by reference numeral 10, is shown in conjunction with a cam lobe 12 of a camshaft 14 and a valve 16 having a valve stem 18. The valve 16 is held normally closed by valve spring 20. The rocker arm assembly 10 engages the valve stem 18 with a valve arm 22 when the cam lobe 12 lifts the cam arm 24. The cam lobe 12 engages a cam roller 26 that is secured to the cam arm 24 as will be more specifically described below.

The location of the cam roller 26 on the cam arm 24 is adjusted by means of an adjustment control shaft 28 that includes at least one adjustment cam 30. The adjustment control shaft also functions as the rocker arm mounting shaft that connects the shaft to the engine. The adjustment cam 30 is turned by the adjustment control shaft 28 to cause the adjustment link 32 to move the cam roller 26 along the length of the cam arm 24.

Figure 2:
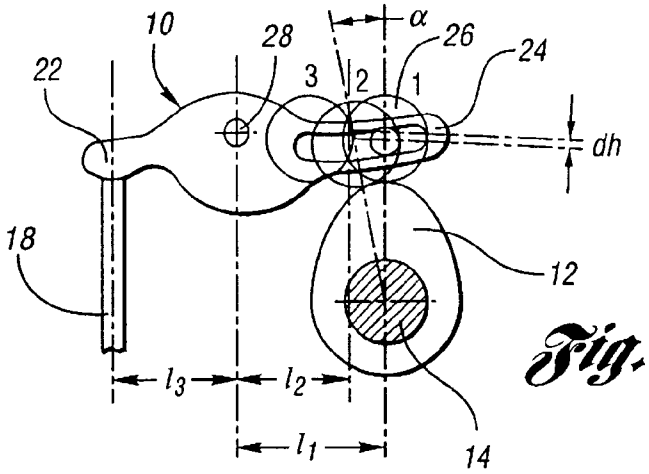
FIG. 2 is an elevation view of a rocker arm assembly showing an adjustable cam roller in three different positions relative to the rotating cam of the engine.

Referring now to FIG. 2, a rocker arm assembly 10 is shown with the cam roller 26 shown in three different positions designated 1, 2 and 3 in FIG. 2. Positions 1 and 2 are active roller positions, wherein the cam roller 26 contacts the cam lobe 12 as it is rotated by the camshaft 14. Position 3 is an inactive position wherein the roller is recessed relative to the cam lobe 12. When the cam roller 26 is in position 3, the valve is not opened as the cam lobe 12 rotates. When the cam roller 26 is in position 3, the rocker arm assembly 10 may function as a variable displacement engine control for deactivating the valve.

The position of the cam roller 26 is changed by rotating the adjustment control shaft 28. As illustrated by positions 1 and 2, the adjustment cam allows for adjustment as indicated by positions 1 and 2 during engine operation. As shown in FIG. 2, adjustment between positions 1 and 2 causes the center line of the roller 26 to move an incremental distance represented by the arrows labeled "dh" that represent the change in height as the roller is adjusted between positions 1 and 2. The adjustment of the roller 26 also causes a change in the timing of valve opening represented by the arcuate arrow designated "$\alpha$". The center line of the roller 26 moves relative to the center line of the camshaft 14 by the amount indicated by "$\alpha$" (change in angle).

When the roller 26 is moved, the distance between the center line of the adjustment control shaft 28 and the center line of the roller 26 is adjusted between lengths $l_1$ and $l_2$. $l_1$ represents the distance between the center line of the roller 26 in position 1 and the adjustment control shaft 28. $l_2$ represents the distance between the center line of the roller 26 in position 2 and the center of the adjustment control shaft 28. As will be readily appreciated by one of ordinary skill in the art, by changing the distance between the center line of the adjustment control shaft 28 and the roller 26, the timing of the valve opening is adjustable within the increment represented by $\alpha$. As the roller is moved between positions 1 and 2, the length of the valve arm 22 remains constant and is represented by arrow "$l_3$". Similarly, the height of the valve opening changes slightly due to the change in the maximum height of the center line of the roller 26. Depending upon the inclination of the cam arm 24, the value for "$\alpha$" may be modified.

Figure 3:
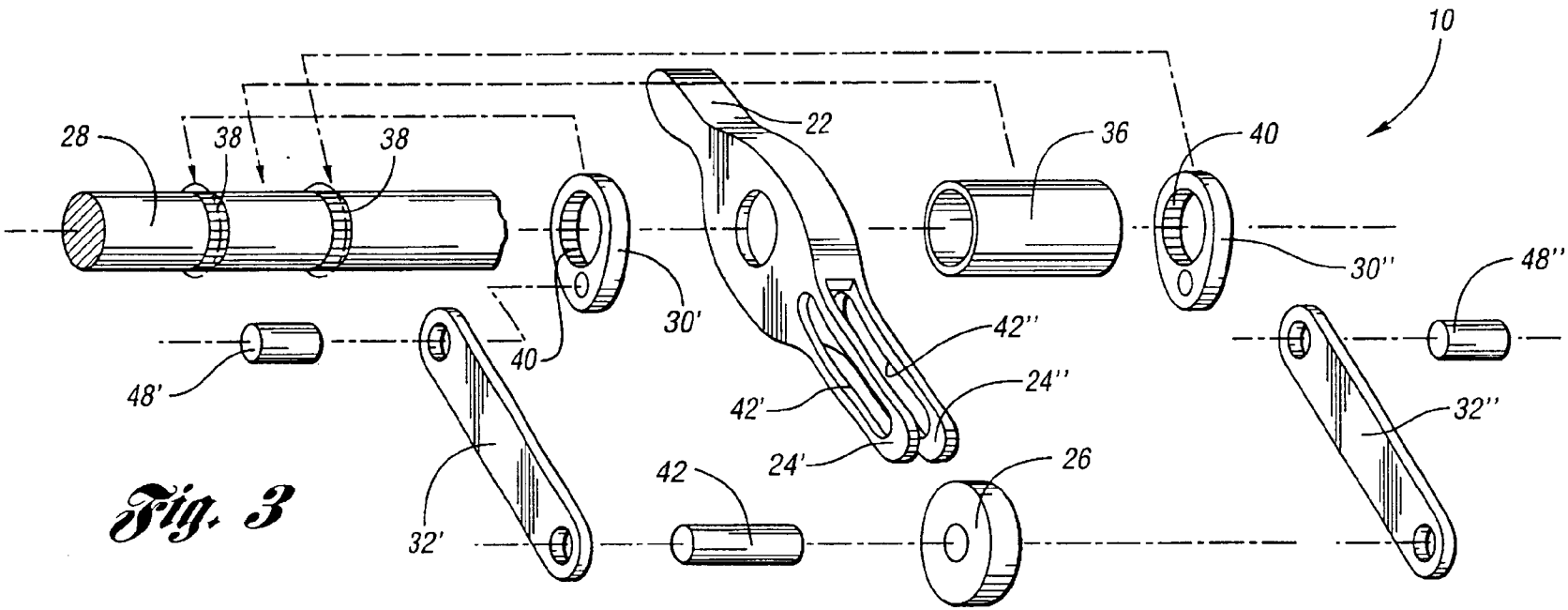
FIG. 3 is an exploded perspective view showing a rocker arm assembly and adjustment linkage for adjusting the position of the cam roller on the rocker arm assembly.

Referring now to FIG. 3, the rocker arm assembly 10 is shown in conjunction with the adjustment control shaft 28. The cam arm 24 is formed in two parts 24' and 24" with a space being provided between the two parts 24', 24" for receiving the cam roller 26. The rocker arm assembly 10 is secured to a bushing 36 that is received on the adjustment control shaft 28 so that the adjustment control shaft may be rotated without affecting the operation or movement of the rocker arm assembly 10. On either side of the bushing 36, adjustment cams 30' and 30" are secured to teeth 38 formed on the adjustment control shaft 28 at spaced locations on either side of the bushing 36. The adjustment cams 30' and 30" have corresponding toothed openings 40 that engage teeth 38 to secure the adjustment cams 30 to the adjustment control shaft 28. As will be readily appreciated by one of ordinary skill in the art, the adjustment cams 30 may be connected by welding, swaging, keys, or by other attachment mechanisms to the adjustment control shaft 28.

A pin 42 supports the cam roller 26 within slots 42' and 42". The pin 42 is moved along the slots 42', 42" when the adjustment links 32', 32" are moved by the adjustment cams 30', 30". The other end of the adjustment links 30', 30" are connected by pins 48', 48". Pins 48' connect the links 32', 32" to the adjustment links 30', 30".

While the best mode for carrying out the invention has been described in detail, those familiar with the art to which this invention relates will recognize various alternative designs and embodiments for practicing the invention as defined by the following claims.

What is claimed is:

1. A valve timing system for internal combustion engine with at least one valve having a valve stem and at least one rotating cam the valve timing system comprising:

a rocker arm pivotally attached to the engine and having a cam arm and a valve arm, the cam arm extending toward the rotating cam and the valve arm contacting the valve stem;

a cam roller attached to the cam arm and being adjustable within a range of positions along the length of the cam arm, the cam roller being supported on the cam arm to selectively contact the rotating cam; and a linkage connected to the cam roller and the rocker arm that adjusts the position of the cam roller to change the timing of the valve of the engine.

2. The valve timing system of claim 1 wherein the cam arm further comprises a pair of spaced flanges between which the cam roller is secured.

3. The valve timing system of claim 1 wherein the cam roller is rotatable on a shaft secured to the cam arm.

4. The valve timing system of claim 1 wherein the linkage comprises an adjustment link and the cam roller is secured to the cam arm by a shaft that is engaged by one end of the adjustment link.

5. The valve timing system of claim 4 wherein the linkage further comprises at least one adjustment cam that is attached to an adjustment control shaft and the adjustment link, a bushing is mounted on the adjustment control shaft and secured to the rocker arm, the bushing being rotatable relative to the adjustment control shaft, wherein the adjustment control shaft may be rotated to rotate the adjustment cam relative to the rocker arm that causes the adjustment link to move the cam roller on the cam arm.

6. The valve timing system of claim 1 wherein the cam roller is secured to the cam arm by a shaft that extends through a slot formed in the cam arm.

7. The valve timing system of claim 6 wherein the slot extends generally lengthwise of the cam arm.

8. The valve timing system of claim 7 wherein one end of the slot is curved away from the rotating cam wherein the cam roller may be moved to a recessed position in which the cam roller does not contact the rotating cam.

9. A valve timing system for internal combustion engine having at least one valve including a valve stem and at least one rotating cam, the valve timing system comprising:

a rocker arm pivotally attached to the engine and having a cam arm and a valve arm, the cam arm comprising a pair of spaced flanges between which the cam roller is secured, the cam arm extending toward the rotating cam and the valve arm contacting the valve stem;

a rotatable cam roller attached to the cam arm and being adjustable within a range of positions along the length of the cam arm, the cam roller being supported on the cam arm to selectively contact the rotating cam; and a linkage connected to the cam roller and the rocker arm that adjusts the position of the cam roller to change the valve timing of the internal combustion engine, the linkage comprising an adjustment link that is used to shift the cam roller, the linkage further comprising at least one adjustment cam that is attached to an adjustment control shaft, a bushing is rotatably mounted on the adjustment control shaft and fixedly secured to the rocker arm, wherein the adjustment control shaft may be rotated to rotate the adjustment cam relative to the rocker arm that causes the adjustment link to move the cam roller on the cam arm, the cam roller being secured to the cam arm by a shaft that is engaged by one end of the adjustment link.

10. A rocker arm assembly for an internal combustion engine having at least one valve that is opened and closed in a timed manner to port combustion gases for a combustion chamber of the internal combustion engine, the internal combustion engine having at least one cam shaft and at least one cam that is rotated by the cam shaft in accordance with the operating cycle of the internal combustion engine, the cam having a lobe that rotates the rocker arm assembly to open and close the valve, the rocker arm assembly comprising:

a rocker arm pivotally secured to the engine and having a valve stem engaging arm and a cam engaging arm on opposite ends thereof;

a roller adjustably secured to the cam engaging arm that may be held on the cam engaging arm in a position to contact the cam as it is rotated by the cam shaft; and an adjustment link for shifting the roller relative to the cam engaging arm to cause the roller to contact the lobe of the cam within a range of rotational positions relative to the cam shaft.

11. The rocker arm assembly of claim 10 wherein the cam engaging arm further comprises a pair of spaced flanges between which the roller is rotatably secured.

12. The rocker arm assembly of claim 10 wherein the adjustment link comprises an elongated link and an adjustment cam, the elongated link having first and second ends with the first end being connected to the roller by a shaft that supports the roller on the cam engaging arm and the second end being connected to the adjustment cam.

13. The rocker cam assembly of claim 12 wherein the adjustment cam is attached to an adjustment control shaft, and wherein a bushing is mounted on the adjustment control shaft and secured to the rocker arm, the bushing being rotatable relative to the adjustment control shaft, wherein the adjustment control shaft may be rotated to rotate the adjustment cam relative to the rocker arm that causes the adjustment link to move the roller relative to the cam engaging arm.

14. The rocker cam assembly of claim 10 wherein the roller is secured to the cam engaging arm by a shaft that extends through a slot formed in the cam engaging arm.

15. The rocker cam assembly of claim 14 wherein the slot extends generally lengthwise of the cam arm.

16. The rocker cam assembly of claim 15 wherein one end of the slot is curved away from the cam wherein the roller may be moved to a recessed position in which the roller does not contact the cam.

* * * * *